US008905341B2

(12) United States Patent
Dorsch et al.

(10) Patent No.: US 8,905,341 B2
(45) Date of Patent: Dec. 9, 2014

(54) SCREW-TYPE CENTRIFUGAL PUMP WITH CUTTING INSERTS

(75) Inventors: Glenn R. Dorsch, Aberdeen, WA (US); Kent H. Keeran, Elma, WA (US); Rich Ballou, Montesano, WA (US); Alex Cahoon, Tumwater, WA (US)

(73) Assignee: Vaughan Company, Inc., Montesano, WA (US)

( * ) Notice: Subject to any disclaimer, the term of this patent is extended or adjusted under 35 U.S.C. 154(b) by 452 days.

(21) Appl. No.: 13/350,874

(22) Filed: Jan. 16, 2012

(65) Prior Publication Data

US 2012/0114462 A1 May 10, 2012

Related U.S. Application Data

(63) Continuation-in-part of application No. 12/220,829, filed on Jul. 29, 2008, now Pat. No. 8,105,017, and a continuation-in-part of application No. 13/273,452, filed on Oct. 14, 2011, now Pat. No. 8,348,188, and a continuation of application No. 12/721,602, filed on Mar. 11, 2010, now Pat. No. 8,118,244.

(51) Int. Cl.

| | |
|---|---|
| ***B02C 23/36*** | (2006.01) |
| ***F04D 29/22*** | (2006.01) |
| ***F04D 7/04*** | (2006.01) |

(52) U.S. Cl.

CPC ..... *F04D 7/045* (2013.01); *F04D 29/225* (2013.01); *F04D 29/2288* (2013.01)

USPC ..... 241/46.017; 241/46.06; 415/121.1

(58) Field of Classification Search

USPC ..... 241/46.06, 46.017; 415/121.1

See application file for complete search history.

(56) References Cited

U.S. PATENT DOCUMENTS

| | | | | |
|---|---|---|---|---|
| 5,460,482 | A * | 10/1995 | Dorsch | 415/121.1 |
| 7,125,221 | B2 * | 10/2006 | Dorsch et al. | 415/121.1 |
| 8,105,017 | B2 * | 1/2012 | Dorsch et al. | 415/121.1 |

* cited by examiner

*Primary Examiner* — Mar Rosenbaum

(74) *Attorney, Agent, or Firm* — Bishop Diehl & Lee, Ltd.

(57) ABSTRACT

A screw-type centrifugal pump with scissoring back cutters and having a housing with an intake opening and an outlet opening, both in fluid communication with an internal chamber, and an impeller assembly positioned within the chamber, is disclosed. Generally speaking, the impeller assembly has a hub having a back shroud and being attached to a rotatable pump shaft, with an impeller attached to the hub. An insert cutter positioned on a surface of the hub shroud opposite the impeller includes a cutting edge configured for shearing operation, while a stationary back plate having a surface adjacent to and facing the hub shroud includes a cutting rib having a cutting edge configured for shearing operation. The insert cutter and cutting rib work jointly to create a cutting action as the hub rotates in the chamber.

23 Claims, 5 Drawing Sheets

SCREW-TYPE CENTRIFUGAL PUMP WITH CUTTING INSERTS

RELATED APPLICATIONS

The present application is a continuation-in-part of and claims priority to U.S. patent application Ser. No. 12/220,829, filed Jul. 29, 2008 and titled "Centrifugal Chopper Pump with Impeller Assembly," now U.S. Pat. No. 8,105,017. The present application is also a continuation-in-part of U.S. patent application Ser. No. 13/273,452, filed on Oct. 14, 2011 and titled "Internal Cutter on Submersed Mixer," which is a continuation of U.S. patent application Ser. No. 12/721,602, filed Mar. 11, 2010 and titled "Internal Cutter on Submersed Mixer," now U.S. Pat. No. 8,118,244. The '017 patent, the '452 application, and the '602 application are all hereby incorporated by reference.

TECHNICAL FIELD OF THE INVENTION

The present device relates to centrifugal pumps used for pumping liquids and slurries containing solid matter, including various types of refuse, which may thereafter be processed for disposal. Particularly, the device relates to a screw-type impeller pump which efficiently pumps fluid without becoming clogged with solid debris.

BACKGROUND OF THE INVENTION

Screw-type impeller pumps have been around for some time. These pumps are known for being quite efficient. In such a pump, a screw-shaped impeller is used to pump fluid through a conical suction piece and then into a more conventional pump casing. The idea of a screw-type pump is to pass chunks of solids through the pump, rather than chop up the solids. It is a special case of a "non-clog" pump.

However, binding of the impeller due to fibrous material (e.g., hair, strings, vines, clothing, etc.) winding about the impeller shaft is a significant problem. Binding increases the torque required from the drive motor, and this can lead to motor overloads and nuisance motor overload tripping. That is, during binding the motor power increases causing the motor protection controls to trip the motor offline. When the motor goes offline, the pumping stops and operator intervention is required to place the motor back online. The down-time, of course, detracts from the cost effectiveness of the process.

In some known prior art screw-type centrifugal pumps, the binding issue may be addressed behind the screw-centrifugal impeller by cutting a spiral groove into the backplate. The backplate is typically formed from gray cast iron or ductile iron. These types of iron are not very hard or wear resistant, so the backplate groove may not last very long. Also, a flat plate on the back of the impeller cutting against a spiral groove is not a very efficient cutter, making such a design still highly susceptible to binding problems.

It is therefore desirable to provide a cutter assembly which helps maintain a clear pump area, reduces wear on parts and improves pumping efficiency to reduce motor power load and pump down-time. The disclosed device affords these and other structural, manufacture and operating efficiencies not seen in prior art devices.

SUMMARY OF THE INVENTION

There is disclosed herein an improved centrifugal pump design which avoids the disadvantages of prior devices while affording additional structural and operating advantages.

Generally speaking, the disclosed centrifugal pump comprises a housing having an intake opening and an outlet opening, both in fluid communication with an internal chamber, and an impeller assembly positioned within the chamber.

In an embodiment of the system, the impeller assembly comprises a hub having a back shroud and being attached to a rotatable motor shaft, an impeller attached to the hub, an insert cutter positioned on the back shroud to extend in a direction opposite the impeller and having a cutting edge configured for shearing operation, a stationary back plate having a surface adjacent to and facing the back shroud, and a cutting rib attached to the back plate surface and having a cutting edge configured for shearing operation.

In operation, the cutting edge of the insert cutter and the cutting edge of the cutting rib are angled and gapped relative to one another to create a cutting action as the insert cutter passes the cutting rib.

In another embodiment an impeller assembly for a centrifugal pump comprises a hub having a back shroud and being attached to a rotatable motor shaft, a screw-type impeller attached to the hub, an insert cutter positioned on the back shroud to extend in a direction opposite the impeller, a back plate having a surface adjacent to and facing the back shroud, and a cutting rib attached to the back plate surface and configured for shearing operation in combination with the insert cutter.

In various embodiments, the cutting rib is aligned radially on the surface of the back plate and a gap between the cutting rib and the insert cutter is preferably in the range of from about 0.005 to 0.050 inches, most preferably in the range of from about 0.010 to about 0.015 inches. Preferably, the insert cutter and the cutting rib are removable and means may be provided to permit the gap to be adjusted, as necessary.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
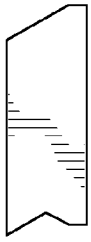
FIGS. 1-6 are a collection of views showing an embodiment of the cutter inserts used in the described invention.
Figure 2:
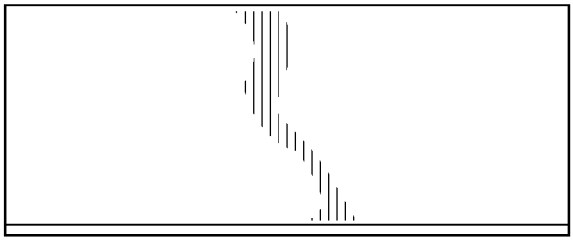
Figure 3:
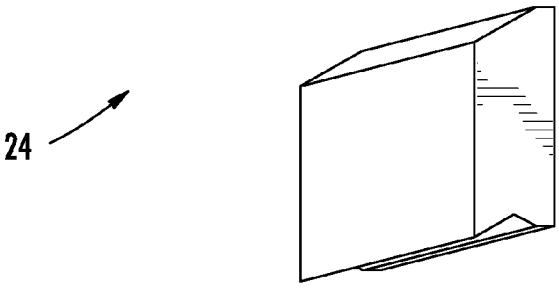

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 7:
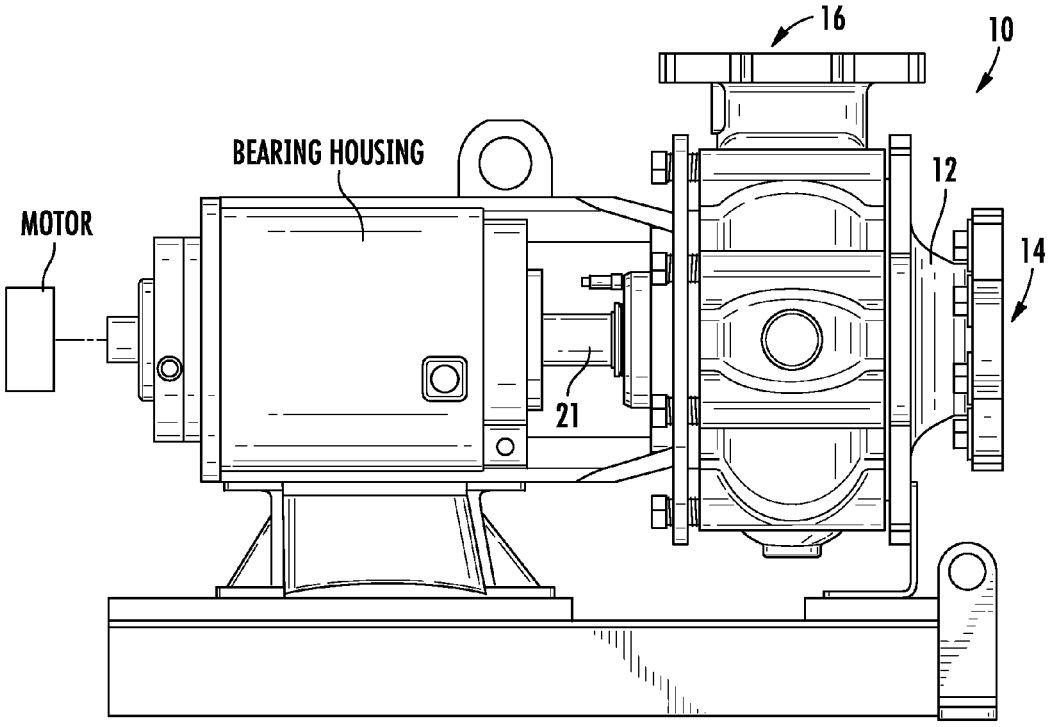
FIG. 7 is a side view of one embodiment of a centrifugal pump.
Figure 8:
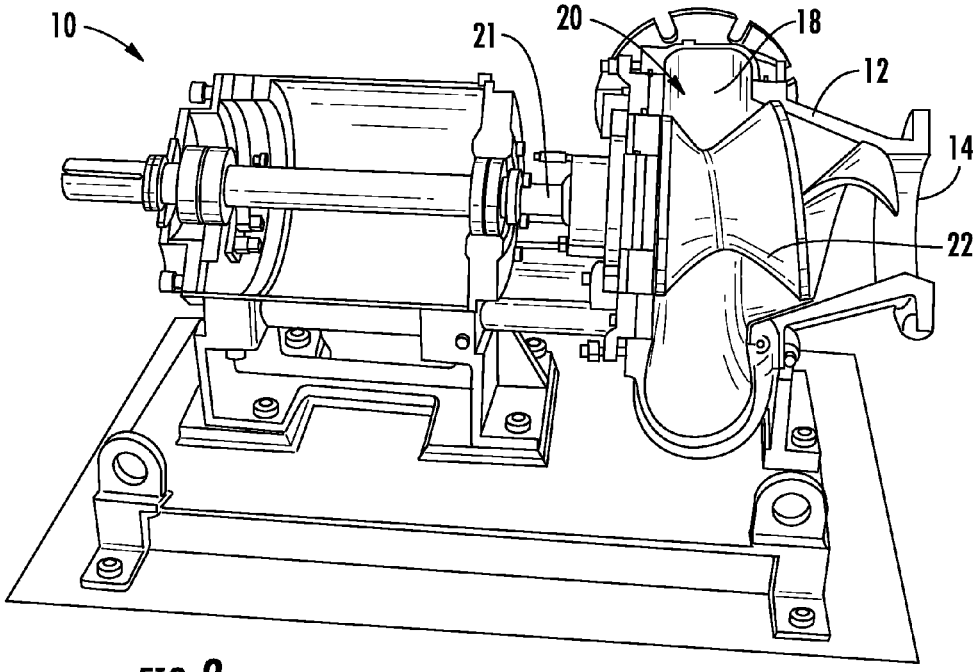
FIG. 8 is a perspective view of the pump of FIG. 7 with a section of the impeller housing and bearing housing cut away.

Referring to FIGS. 1-14, there is illustrated in the several views a centrifugal pump, generally designated by the numeral 10, and various components of pump 10. As best shown in FIGS. 7 and 8, the pump 10 has a suction cone 12 having an intake opening 14 and an outlet opening 16, both in fluid communication with an internal chamber 18. Within the chamber 18 is positioned an impeller assembly 20. Generally speaking, the impeller assembly 20 comprises an impeller 22 which is mounted to an impeller hub 26 having a shroud 30. A fixed back plate 28 is adjacent to the rotating impeller assembly 22. The hub 26 is connected to a pump drive shaft 21 which imparts rotation to the hub 26 and, thereby, the attached impeller 22. The impeller 22 is preferably a screw-type design having a single blade 31, as shown. Unlike chopper pumps as disclosed in U.S. Pat. No. 8,105,017 (application Ser. No. 12/220,829), the entirety of which has been incorporated by reference, the screw-type centrifugal pump of this invention has eliminated pump-out vanes on the impeller shroud for greater efficiency. For detail on the typical operation and structure of a screw-type centrifugal pump, U.S. Pat. No. 7,510,368 to Stahle is hereby incorporated by reference.

At the bottom end of the impeller 22 is an opening (not shown) which allows the impeller 22 to be mounted to the hub 26. The back surface 35 of shroud 30 of the hub 26 faces a fixed back plate 28, as is explained below.

Figure 4:
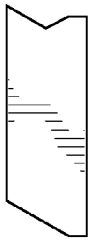
Figure 5:
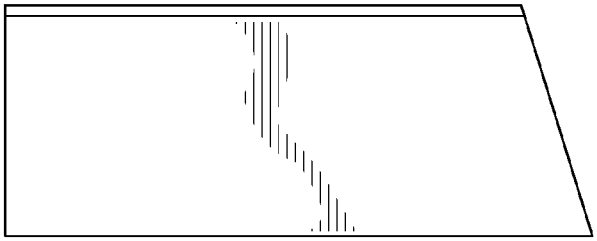
Figure 6:
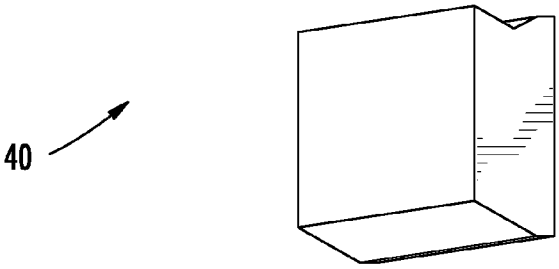

A unique aspect of the present invention is the use of two cutting inserts/ribs, shown in FIGS. 1-6, as they are positioned in the facing surfaces of the back plate 28 and back surface 35 of the shroud 30. As will be explained in greater detail below, the two cutting inserts/ribs cooperate to scissor material that infiltrates the area between the two surfaces and may threaten to wrap around the pump shaft. While the two cutting inserts/ribs may be very similar in design, as best illustrated in FIGS. 1 and 4, they are referenced herein as an insert cutter 24 on the hub shroud 30 and as a cutting rib 40 on the back plate 28. This nomenclature helps to more readily understand the discussion which follows.

Figure 9:
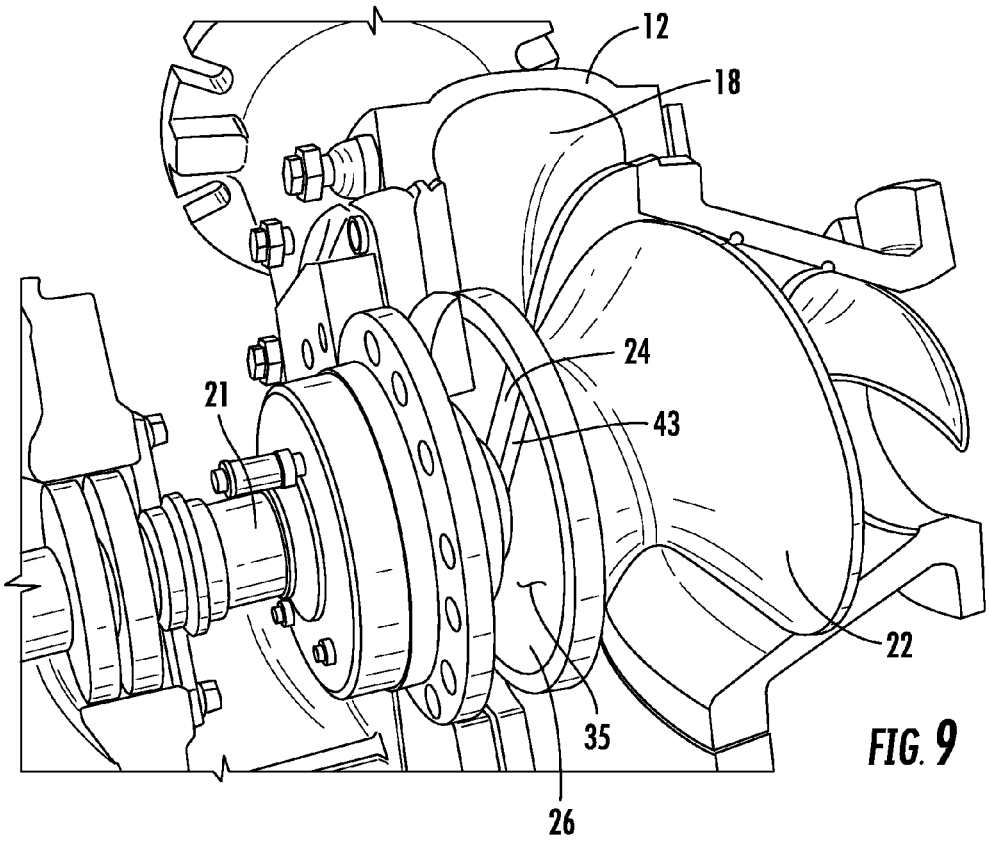
FIG. 9 is a side perspective view showing the screw-type impeller of FIG. 8.
Figure 10:
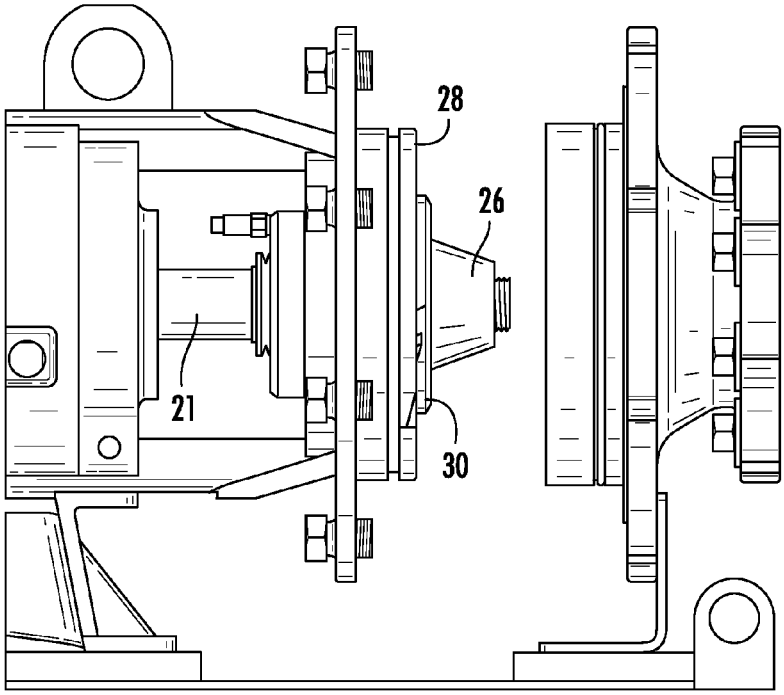
FIG. 10 is a side view of an embodiment of the invention with the impeller and housing removed to show the impeller hub and back plate relationship.
Figure 14:
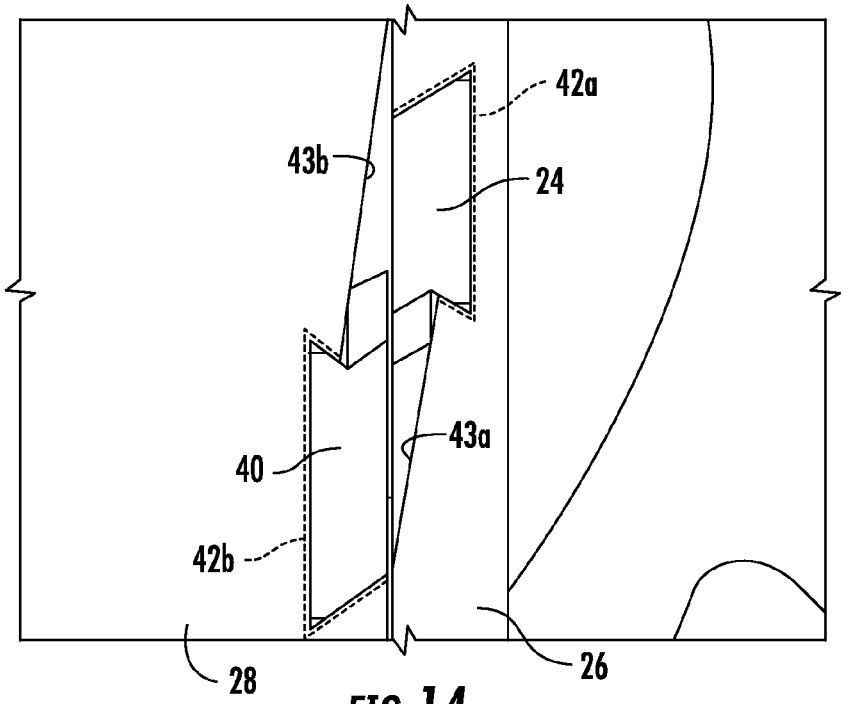
FIG. 14 is a side view illustrating the shearing relationship between an embodiment of the two cutter inserts.

As previously noted, the insert cutter 24 is mounted to the back surface 35 of the hub shroud 30 where pump-out vanes would normally be located. The insert cutter 24 is preferably positioned radially, off-center on surface 35 of the hub shroud 30 facing the back plate 28. The shroud 30, as shown in FIGS. 9 and 14, preferably includes a dovetail groove 42*a* for insertion of the insert cutter 24 to form a first cutting area. Naturally, the groove 42*a* can be of any configuration which allows replacement of the insert cutter 24. Preferably, the groove 42*a* is cut into the surface 35 of the hub shroud 30 to be somewhat off-center. In some desired embodiments, the insert cutter 24 may be formed to be integral or otherwise permanent to the shroud 30. This may be accomplished by machining a cutting groove or welding a proper insert cutter 24 to the surface 35 of the shroud 30.

Figure 11:
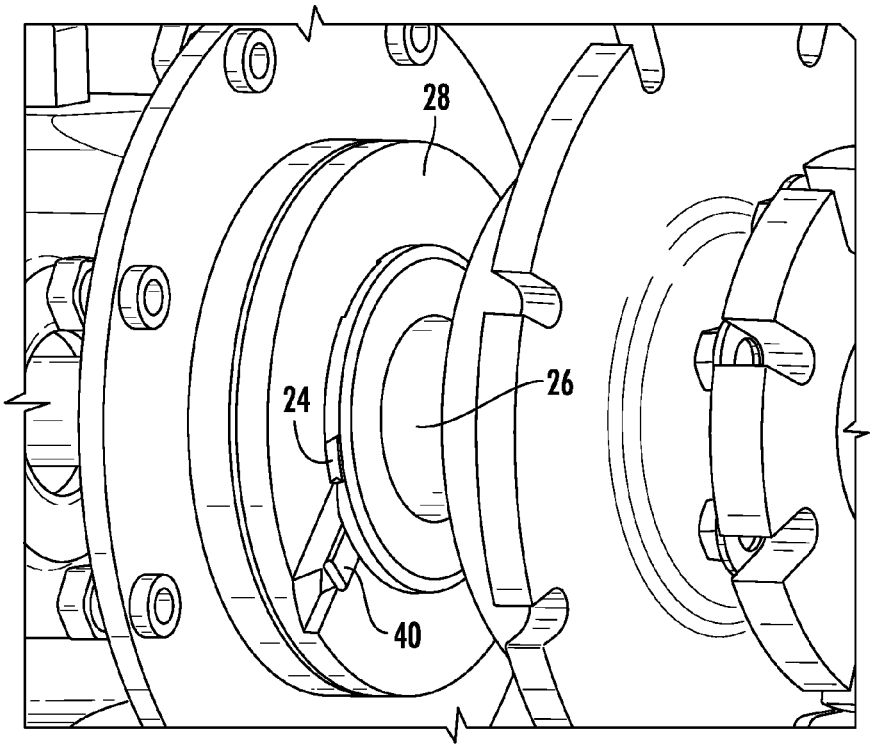
FIG. 11 is a cut-away view showing an embodiment of the insert cutter and cutting rib.
Figure 12:
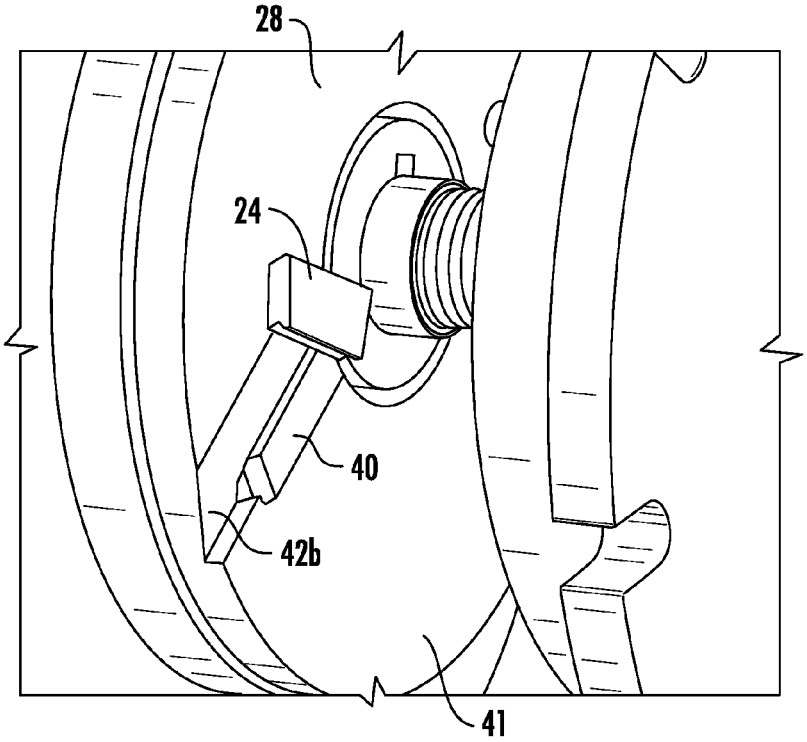
FIG. 12 is a view similar to that of FIG. 11 with the impeller hub removed to illustrate the scissoring angle between the insert cutter and cutting rib.
Figure 13:
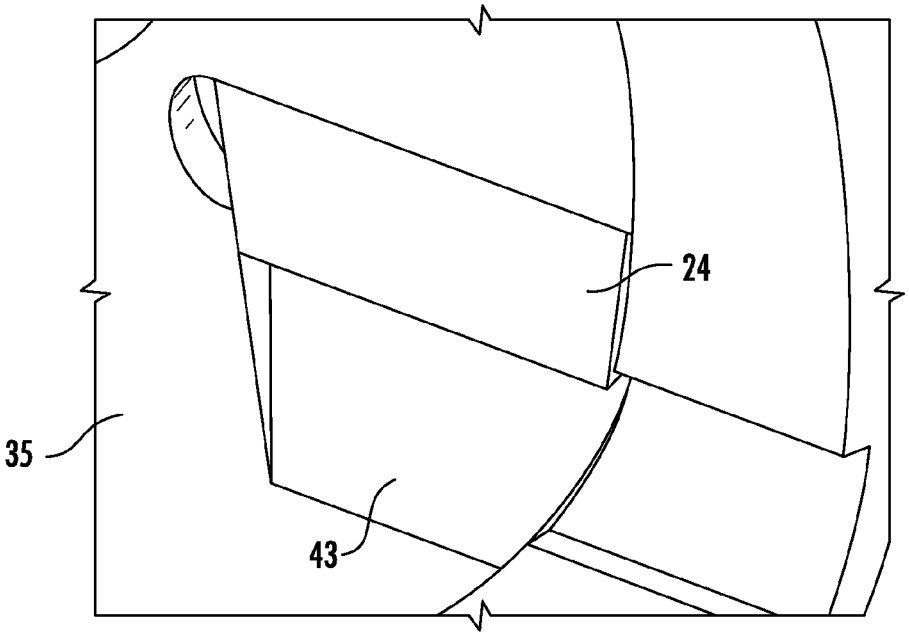
FIG. 13 is a close-up view of the insert cutter in a recess of the impeller hub.

The back plate 28 is bolted at the back of the chamber 18 and includes a second cutting area positioned radially, off-center on surface 41 of the back plate 28 facing the surface 35 of the hub shroud 30. The back plate 28, as shown in FIGS. 11, 12 and 13, preferably includes a dovetail groove 42*b* for insertion of cutting rib 40. As the back plate 28 is stationary, the second cutting area 39 and, therefore, the cutting rib 40 is also fixed. Naturally, the groove 42*b* can be of any configuration which allows replacement of the rib 40. Preferably, the groove 42*b* is cut into the surface 41 of the back plate 28 to be somewhat off-center. In some desired embodiments, the cutting rib 40 may be formed to be integral or otherwise permanent to the back plate 28. This may be accomplished by machining a cutting groove or welding a proper rib 40 to the back plate 28.

The use of a removable cutting rib 40 and insert cutter 24 allows (1) a hardened metal material to be used for manufacturing these parts, which is more durable than the materials used for either the hub or back plate and, (2) replacement of the rib and insert when either becomes worn beyond a useful form. The off-center positioning of the grooves 42*a* and *b* and the angle of the rib 40 and insert 24 relative to one another allows for a better cutting action (i.e., a scissoring) between the cutting rib 40 and the insert cutter 24 of the hub shroud 30 as well as a better flushing path for the cut material. Naturally, the cutting angle can be adjusted to operate within most any given range by properly configuring the angle of the rotating insert cutter 24 in relation to the fixed cutting rib 40.

It is believed that only a single cutting rib 40 and a single insert cutter 24 are required with most pump applications. However, in some instances it may be desirable or necessary to use multiple cutting ribs 40 and/or multiple insert cutters 24. Such additional cutters may be positioned in consecutive or alternate quadrants from one another, or otherwise as necessary, on the surfaces of the hub shroud 30 and back plate 28.

As to both cutting areas 29 and 39, a sloping recessed area 43 precedes the groove 42*a* and *b* in the surface 35 of the shroud 30 and the surface 41 of the back plate 28, respectively. The sloping recessed areas 43 help to expose more of the cutting rib 40 and insert cutter 24 during the shearing action.

In the present embodiment, the cutting rib 40 and insert cutter 24 are preferably made of one of either a hardened steel or hardened stainless steel. As a hardened steel, the finished cutter preferably has a hardness measure of at least HRC 60, and as a hardened stainless steel, a measure of about HRC 40. Such hardness gives both the cutting rib 40 and the insert cutter 24 the necessary durability to operate effectively and efficiently before needing replacement.

As stated above, the insert cutter 24 and cutting rib 40 fit tightly within the corresponding groove 42 machined into the surfaces of the shroud 30 and back plate 28, respectively. In addition to this close fit within the preferably dovetailed grooves 42*a* and *b*, the insert cutter 24 and cutting rib 40 should be held in place using a high-strength adhesive and may be further retained mechanically by obstructions placed at each end of the respective groove 42. As the insert 24 and rib 40 becomes worn, they may be removed and readily replaced.

In addition to the sloping recessed areas 43 described above, the cutting rib 40 and insert cutter 24 are also preferably positioned such that they are flush with the respective (hub shroud 30 and back plate 28) surfaces. This allows the shroud 30 and back plate 28 to be positioned with tighter clearances for better pump efficiency. Solid material is directed downward into the recessed area 43 where it is impacted by the scissoring insert cutter 24 and cutting rib 40. Further, the recessed area 43 also facilitates the channeling of cut material outward from the pump shaft. A gap created between the back cutting rib 40 and insert cutter 24 is preferably within the range of from about 0.005 to about 0.05 inches (0.0127 to 0.127 cm), and most preferably in the range of from about 0.010 to 0.015 inches (0.0254 to 0.0381 cm). The gap is very important to the efficient operation between the cutting rib 40 and the insert cutter 24. If the gap is too large, material will not be prevented from wrapping about the pump shaft and the drive motor power required may be excessive, resulting in motor overload tripping. If the gap is too narrow, metal-to-metal contact problems may occur during pump operation and expedited wear on the insert and rib will result.

Alternatively, the recessed areas described may be omitted and the upper edges of the cutting rib 40 and insert cutter 24 may be raised above the surface of the corresponding plate. In this embodiment, a necessary gap, similar to that described above, should be maintained between the cutting edges. However, a larger gap will exist between the hub shroud 30 and back plate 28 surfaces. While this configuration will negatively impact pump efficiency, it may be used with similar success in certain pump applications.

In operation, liquids or slurries including solid waste material (collectively "fluid") enter the inlet opening 14 of the pump 10 as a result of the suction created by the impeller 22 motion turned by pump shaft 21. While the present system may be employed for most any pump operations, it is particularly useful for small electric motor systems. By "small motors" it is meant to include such motors rated under 30 horsepower (hp), especially those in the 5 to 10 hp range. The reason for particular application to these motors relates to the overload tendency of such motors due to the additional torque required to overcome the binding caused by solid waste gathering between the hub shroud 30 of the hub 26 and the stationary back plate 28 as previously mentioned. The disclosed invention is certainly suitable for motors of greater than 30 hp, including large pumps in the 60 to 200 hp range, but such motors are less affected by power increases and are, therefore, less susceptible to going offline due to such an increase.

The fluid enters the chamber 18 and from there, most fluid travels from the chamber 18 to the outlet port opening 16. Some of the fluid ends up between the impeller hub shroud 30 and the back plate 28 where it is subject to the shearing action between the insert cutter 24 and the cutting rib 40. These components should be carefully gapped to provide the most efficient and effective cutting of difficult material—i.e., material which is not readily broken, but must be cut with scissor like action. Eventually, the fluid from this area is delivered to the outlet port opening 16 for discharge.

While the present invention is exclusively described herein for use on a screw-type centrifugal pump, for example, TRITON® pumps sold by Vaughan, the inventors concede that it may have practical uses on other types of pumps as well. For example, the dual cutting ribs may be used on chopper pumps and on vortex (i.e., recessed impeller) pumps to pump relatively "clean" sludge in a system. By "clean" it is meant that the sludge has no large debris to be chopped by the pump. Such sludge is still replete with fine fibers, such as hair, strands of fabric and the like. The use of the cutting ribs exclusively for such pump systems would be useful.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An impeller assembly for a centrifugal pump comprising:

a hub having a back shroud and being attached to a rotatable pump shaft;

a screw-type impeller attached to the hub;

an insert cutter positioned on a surface of the back shroud opposite the impeller;

a back plate having a surface adjacent to and facing the back shroud; and a cutting rib attached to the back plate surface and configured for shearing operation in combination with the insert cutter.

2. The assembly of claim 1, wherein the cutting rib is stationary.

3. The assembly of claim 2, wherein the cutting rib is aligned radially on the surface of the back plate.

4. The assembly of claim 3, wherein the cutting rib is flush with the surface of the back plate.

5. The assembly of claim 1, wherein a gap between the cutting rib and the insert cutter is in the range of from about 0.005 to 0.050 inches.

6. The assembly of claim 5, wherein the gap is in the range of from about 0.010 to about 0.015 inches.

7. The assembly of claim 5, wherein the gap is adjustable.

8. The assembly of claim 1, wherein the surface of the back plate comprises a recessed area and a single cutting rib is attached within the recess.

9. The assembly of claim 1, wherein the surface of the hub shroud comprises a recessed area and a single insert cutter is attached within the recess.

10. The assembly of claim 1, wherein both the cutting rib and the insert cutter are comprised of one of either hardened stainless steel or hardened steel.

11. The assembly of claim 10, wherein both the cutting rib and the insert cutter are comprised of hardened steel having a hardness measure of at least HRC 60.

12. The assembly of claim 10, wherein both the cutting rib and the insert cutter are comprised of hardened stainless steel having a hardness measure of about HRC 40.

13. The assembly of claim 1, wherein the cutting rib is detachable from the back plate surface to allow replacement of the cutting rib.

14. The assembly of claim 1, wherein the back plate comprises a plurality of cutting ribs attached thereto.

15. The assembly of claim 1, wherein the insert cutter is aligned radially on the surface of the hub shroud.

16. The assembly of claim 15, wherein the insert cutter is flush with a surface of the hub shroud.

17. The assembly of claim 15, wherein the surface of the hub shroud comprises a recessed area and a single insert cutter is attached within the recess.

18. The assembly of claim 1, wherein the insert cutter is detachable from the hub shroud surface to allow replacement of the insert cutter.

19. The assembly of claim 1, wherein the hub shroud comprises a plurality of insert cutters attached thereto.

20. A centrifugal pump comprising:

a housing having an intake opening and an outlet opening, both in fluid communication with an internal chamber; and an impeller assembly positioned within the chamber, the impeller assembly comprising:

a hub having a back shroud and being attached to a rotatable pump shaft;

an impeller attached to the hub;

an insert cutter positioned on a surface of the hub shroud opposite the impeller and having a cutting edge configured for shearing operation;

a stationary back plate having a surface adjacent to and facing the hub shroud; and a cutting rib attached to the back plate surface and having a cutting edge configured for shearing operation;

wherein the cutting edge of the insert cutter and the cutting edge of the cutting rib are angled and gapped relative to one another to create a cutting action as the insert cutter passes the cutting rib.

21. The centrifugal pump of claim 20, wherein the impeller is a screw-type impeller.

22. The centrifugal pump of claim 20, wherein the insert cutter and the cutting rib are flush with a surface of the hub shroud and a surface of the back plate, respectively.

23. The centrifugal pump of claim 20, wherein the insert cutter and the cutting rib are raised above a surface of the hub shroud and a surface of the back plate, respectively.

* * * * *